US009227452B2

(12) United States Patent
Oguri et al.

(10) Patent No.: US 9,227,452 B2
(45) Date of Patent: Jan. 5, 2016

(54) RECORDING MEDIUM

(71) Applicant: CANON KABUSHIKI KAISHA, Tokyo (JP)

(72) Inventors: Isamu Oguri, Yokohama (JP); Hisao Kamo, Ushiku (JP); Tetsuro Noguchi, Hachioji (JP); Shinya Yumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/451,257

(22) Filed: Aug. 4, 2014

(65) Prior Publication Data

US 2015/0044398 A1 Feb. 12, 2015

(30) Foreign Application Priority Data

Aug. 6, 2013 (JP) ..... 2013-163274

(51) Int. Cl.

| | |
|---|---|
| ***B41M 5/00*** | (2006.01) |
| ***B41M 5/52*** | (2006.01) |
| ***B41M 5/50*** | (2006.01) |

(52) U.S. Cl.

CPC ..... *B41M 5/5218* (2013.01); *B41M 5/502* (2013.01); *B41M 5/52* (2013.01); *B41M 5/5227* (2013.01)

(58) Field of Classification Search

CPC ... B41M 5/5218; B41M 5/502; B41M 5/5227
USPC ..... 428/32.26, 32.3, 32.34, 32.35
See application file for complete search history.

(56) References Cited

U.S. PATENT DOCUMENTS

| | | | | |
|---|---|---|---|---|
| 4,310,600 | A * | 1/1982 | Cross | 428/447 |
| 2003/0064208 | A1 * | 4/2003 | Yamada et al. | 428/195 |
| 2006/0182903 | A1 * | 8/2006 | Sakaguchi et al. | 428/32.24 |
| 2006/0204687 | A1 | 9/2006 | Iwasaki | |
| 2007/0202281 | A1 * | 8/2007 | Nelli | 428/32.34 |
| 2008/0241436 | A1 * | 10/2008 | Kobayashi | 428/32.22 |
| 2011/0058006 | A1 | 3/2011 | Kobayashi | |

FOREIGN PATENT DOCUMENTS

| | | |
|---|---|---|
| JP | 2007-152777 A | 6/2007 |

* cited by examiner

*Primary Examiner* — Betelhem Shewareged
(74) *Attorney, Agent, or Firm* — Canon USA Inc. IP Division

(57) ABSTRACT

A recording medium has a base and an ink receiving layer, in which the ink receiving layer contains colloidal silica, a zirconium compound, an ammonium salt, and hydroxycarboxylic acid and 90% or more of the colloidal silica contained in the ink receiving layer exists in a region of 0 nm or more and 300 nm or less in the depth direction from the outermost surface of the recording medium.

12 Claims, 1 Drawing Sheet

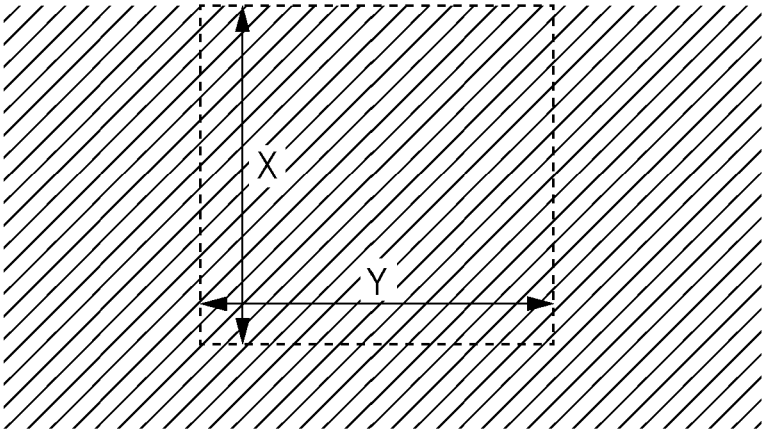
X
Y

RECORDING MEDIUM

BACKGROUND OF THE INVENTION

1. Field of the Invention

The present invention relates to a recording medium.

2. Description of the Related Art

As a recording medium for use in an ink jet recording method and the like, a recording medium having a porous ink receiving layer containing inorganic particles on a base is known. In such a porous ink receiving layer, when the number of voids is large, the refractive index of the ink receiving layer is low. Therefore, there is a tendency for the reflectivity on the surface of the ink receiving layer to decrease, and thus the glossiness of the recording medium decreases. Then, as a method of improving the glossiness of the recording medium, a method of providing a gloss layer containing colloidal silica on the outermost surface of the recording medium is known. A reason why the glossiness of the recording medium improves as a result of the recording medium containing the colloidal silica is as follows. The colloidal silica is likely to take a configuration in which the colloidal silica is densely packed when the ink receiving layer is formed as compared with other inorganic particles. Therefore, since the number of voids, which lead to a decrease in glossiness, decreases, the glossiness becomes high. Japanese Patent Laid-Open No. 2007-152777 describes a recording medium having a gloss imparting layer containing the colloidal silica.

SUMMARY OF THE INVENTION

A recording medium according to aspects the present invention has a base and an ink receiving layer, in which the ink receiving layer contains colloidal silica, a zirconium compound, an ammonium salt, and hydroxycarboxylic acid and 90% or more of the colloidal silica contained in the ink receiving layer exists in a region of 0 nm or more and 300 nm or less in the depth direction from the outermost surface of the recording medium.

Further features of the present invention will become apparent from the following description of exemplary embodiments with reference to the attached drawing.

BRIEF DESCRIPTION OF THE DRAWINGS

FIGURE is a view explaining a method of calculating the existence ratio of colloidal silica existing in a region of 0 nm or more and 300 nm or less in the depth direction from the outermost surface of a recording medium.

DESCRIPTION OF THE EMBODIMENTS

According to an examination of the present inventors, in the recording medium described in Japanese Patent Laid-Open No. 2007-152777, although the glossiness has been improved, the scratch resistance has been low in some cases.

Therefore, the present invention provides a recording medium excellent in glossiness and scratch resistance.

Hereinafter, the present invention is described in detail with reference to preferable embodiments.

The present inventors first examined the cause of the reduction in the scratch resistance of a recording medium having an ink receiving layer containing colloidal silica. As a result, the present inventors have reached a conclusion that voids formed by the colloidal silica are easily crushed due to external stress. However, the ink receiving layer containing the colloidal silica exhibits high ink absorbability by absorbing ink into the voids, and therefore the voids cannot be eliminated. Then, the present inventors examined a method of increasing the strength of the ink receiving layer itself without eliminating the voids of the ink receiving layer.

As a result of the examination performed by the present inventors, the present inventors have developed a method of using an ammonium salt of a zirconium compound and hydroxycarboxylic acid with the colloidal silica for the ink receiving layer. The colloidal silica has a property of becoming partially hydrolyzed when the colloidal silica becomes basic. It is thought that, since the ammonium salt of the zirconium compound is basic, the surfaces of the colloidal silica is partially hydrolyzed by the use of the ammonium salt of the zirconium compound with the colloidal silica to be strongly bonded to the zirconium compound. In this case, it is thought that the reactivity is moderately controlled due to the fact that hydroxycarboxylic acid is present, and the bonding force of the zirconium compound and the colloidal silica further increases. The ammonium salt of the zirconium compound exists in the form of a zirconium compound and an ammonium salt after the ink receiving layer has been formed. More specifically, the recording medium of the present invention has an ink receiving layer containing colloidal silica, a zirconium compound, an ammonium salt, and hydroxycarboxylic acid.

Furthermore, the present inventors have examined a method of increasing the glossiness of the recording medium, which was originally the purpose of using the colloidal silica, and then it has been found that 90% or more of the colloidal silica contained in the ink receiving layer are required to exist in a region of 0 nm or more and 300 nm or less in the depth direction from the outermost surface of the recording medium.

As in the above-described mechanism, because each of the elements affects each other in a synergistic manner, the effects of the present invention can be achieved.

Recording Medium

The recording medium of the present invention has a base and an ink receiving layer. In the present invention, the recording medium may be preferably used as an ink jet recording medium for use in an ink jet recording method.

In the present invention, the arithmetic average roughness Ra specified by JIS B 0601:2001 of the surface of the recording medium is preferably 1.0 μm or less, more preferably 0.5 μm or less, and particularly preferably 0.2 μm or less. Examples of a method of adjusting the surface roughness of the recording medium using a resin coated base include a method of pressing a roll having specific irregularities or a smooth roll against the surface of the resin coated base, and then applying a coating liquid for an ink receiving layer onto the surface, a method of pressing a roll having specific irregularities or a smooth roll against the surface of the recording medium, and the like.

Hereinafter, each component constituting the recording medium of the present invention is described.

Base

Examples of materials which can be used for a base include paper, film, glass, metal, and the like. Among the above, a base containing paper, i.e., a so-called base paper, is preferably used.

When using the base paper, the base paper may be used as the base or one in which the base paper is covered with a resin layer may be used as the base. In the present invention, the base having the base paper and a resin layer is preferably used. In this case, the resin layer may be provided only on one surface of the base paper but is preferably provided on both surfaces thereof.

The film thickness of the base is preferably 25 μm or more and 500 μm or less and more preferably 50 μm or more and 300 μm or less.

Base Paper

The base paper is made using wood pulp as the main material and, as required, adding synthetic pulp, such as polypropylene, and synthetic fibers, such as nylon and polyester. Examples of the wood pulp include leaf bleached kraft pulp (LBKP), leaf bleached sulphite pulp (LBSP), northern bleached kraft pulp (NBKP), northern bleached sulphite pulp (NBSP), leaf dissolving pulp (LDP), northern dissolving pulp (NDP), leaf unbleached kraft pulp (LUKP), northern unbleached kraft pulp (NUKP), and the like. One or two or more kinds thereof can be used as required. Among the wood pulp, LBKP, NBSP, LBSP, NDP, and LDP containing short fiber components in a high proportion are preferably used. As the pulp, chemical pulp with few impurities (sulfate pulp and sulfite pulp) is preferable. Moreover, pulp whose degree of whiteness is improved by performing bleaching treatment is also preferable. Into the base paper, a sizing agent, a white pigment, a paper reinforcing agent, a fluorescent brightening agent, a moisture maintenance agent, a dispersing agent, a softening agent, and the like may be added as appropriate In the present invention, the film thickness of the base paper is preferably 50 μm or more and 500 μm or less and more preferably 90 μm or more and 300 μm or less. In the present invention, the film thickness of the base paper is calculated by the following method. First, the cross section of the recording medium is cut out by using a microtome, and then the cross section is observed under a scanning electron microscope. Then, the film thickness of arbitrary 100 or more points of the base paper is measured, and the average value is defined as the film thickness of the base paper. The film thickness of the other layers in the present invention is also calculated by the similar method.

In the present invention, the paper density specified by JIS P 8118 of the base paper is preferably 0.6 g/cm$^3$ or more and 1.2 g/cm$^3$ or less. Furthermore, the paper density is more preferably 0.7 g/cm$^3$ or more and 1.2 g/cm$^3$ or less.

Resin Layer

In the present invention, when the base paper is covered with resin, the resin layer may be provided in such a manner as to partially cover the base paper surface. Furthermore, the coverage (Area of base paper surface covered with resin layer/Entire area of base paper surface) of the resin layer is preferably 70% or more, more preferably 90% or more, and particularly preferably 100%, i.e., the entire surface of the base paper surface is covered with the resin layer.

Moreover, in the present invention, the film thickness of the resin layer is preferably 20 μm or more and 60 μm or less and more preferably 35 μm or more and 50 μm or less. When providing the resin layer on both surfaces of the base paper, it is preferable for the film thickness of each of the resin layers on both surfaces to satisfy the range above.

Moreover, the 60° specular gloss specified by JIS Z 8741 of the resin layer is preferably 25% or more and 75% or less. Furthermore, the ten-point average roughness specified by JIS B 0601:2001 of the resin layer is preferably 0.5 μm or less.

As the resin for use in the resin layer, thermoplastic resin is preferable. Examples of the thermoplastic resin include acrylic resin, acrylic silicone resin, polyolefin resin, a styrene-butadiene copolymer, and the like. Among the above, the polyolefin resin is preferably used. In the present invention, the polyolefin resin is a polymer containing olefin as a monomer. Specifically, homopolymers and copolymers, such as ethylene, propylene, and isobutylene, are mentioned. As the polyolefin resin, one or two or more kinds thereof can be used as required. Among the above, polyethylene is preferably used. As the polyethylene, a low density polyethylene (LDPE) and a high-density polyethylene (HDPE) are preferably used.

In the present invention, the resin layer may contain a white pigment, a fluorescent brightening agent, ultramarine, and the like in order to adjust the opacity, the degree of whiteness, and the hue. Among the above, since the opacity can be improved, the white pigment is preferably used. Examples of the white pigment include a rutile type titanium oxide or an anatase type titanium oxide. In the present invention, the content of the white pigment in the resin layer is preferably 3 g/m$^2$ or more and 30 g/m$^2$ or less. When providing the resin layer on both surfaces of the base paper, it is preferable that the total content of the white pigments in the two resin layers satisfies the range above. The content of the white pigment in the resin layer is preferably 25% by mass or less based on the resin content. When the white pigment content is larger than 25% by mass, the dispersion stability of the white pigment is not sufficiently obtained in some cases.

Ink Receiving Layer

The recording medium of the present invention has the ink receiving layer containing colloidal silica, a zirconium compound, an ammonium salt, and hydroxycarboxylic acid. In the present invention, the ink receiving layer containing colloidal silica, a zirconium compound, an ammonium salt, and hydroxycarboxylic acid is preferably an ink receiving layer on the outermost surface of the recording medium. The ink receiving layer may be a single layer or a multilayer containing two or more layers. The ink receiving layer may be provided only on one surface of the base or may be provided on both surfaces of the base. In the present invention, the ink receiving layer is preferably provided on both surfaces. The film thickness of the ink receiving layer on one surface of the base is preferably 10 μm or more and 60 μm or less and more preferably 15 μm or more and 45 μm or less.

In the present invention, the void ratio of the ink receiving layer is preferably 30% or more and more preferably 40% or more from the viewpoint of ink absorbability. As described above, the present invention achieves an increase in the strength of the ink receiving layer itself without eliminating the voids of the ink receiving layer and satisfies the void ratio of 30% or more by satisfying the configuration of the present invention. The void ratio of the ink receiving layer is calculated by dividing the total pore volume of the ink receiving layer per unit area by the volume of the ink receiving layer per unit area. The volume of the ink receiving layer per unit area is determined from the film thickness and the area of the ink receiving layer. The total pore volume of the ink receiving layer is determined using the BJH (Barrett-Joyner-Halenda) method by measuring the nitrogen gas adsorption-desorption isotherm of the recording medium by a nitrogen adsorption-desorption method. The average pore radius of the ink receiving layer is preferably 5 nm or more and 20 nm or less. The average pore radius of the ink receiving layer is determined from the total pore volume and the specific surface area of the ink receiving layer.

Colloidal Silica

In the present invention, the average primary particle size of the colloidal silica is preferably 10 nm or more and 120 nm or less. The average primary particle size is more preferably 20 nm or more and 100 nm or less. When the average primary particle size is smaller than 20 nm, the ink absorbability is not sufficiently obtained in some cases. When the average primary particle size is larger than 100 nm, the improvement effect of the scratch resistance is not sufficiently obtained in some cases. In the present invention, the average primary particle size of the colloidal silica is the number-average particle size of the diameter of a circle having an area equal to the projected area of the primary particles of the colloidal silica when observed under an electron microscope. At this time, the measurement is performed at at least 100 points.

In the present invention, among the colloidal silica, spherical colloidal silica is preferable because the scratch resistance and the glossiness increase. The "spherical" used herein refers to a shape in which a ratio b/a of the average major axis a of colloidal silica (50 or more and 100 or less) and the average minor axis b when observed under a scanning electron microscope falls in the range of 0.80 or more and 1.00 or less. The b/a is more preferably 0.90 or more and 1.00 or less and particularly preferably 0.95 or more and 1.00 or less. Specifically, examples of a commercially available colloidal silica include Quotron: PL-3, PL-3L (all manufactured by Fuso Chemical Co., Ltd.); Snowtex: 20, 20L, ZL, AK, AK-L (all manufactured by Nissan Chemical Industries), and the like.

The content of the colloidal silica in the ink receiving layer is preferably 0.01 $g/m^2$ or more and more preferably 0.02 $g/m^2$ or more from the viewpoint of scratch resistance. The content of colloidal silica is preferably 0.5 $g/m^2$ or less and more preferably 0.1 $g/m^2$ or less from the viewpoint of ink absorbability. The content of the colloidal silica in the ink receiving layer is particularly preferably 0.02 $g/m^2$ or more and 0.1 $g/m^2$ or less.

In the present invention, 90% or more of the colloidal silica contained in the ink receiving layer are required to exist in a region of 0 nm or more and 300 nm or less in the depth direction from the outermost surface of the recording medium. Furthermore, it is preferable that 90% or more of the colloidal silica contained in the ink receiving layer exists in a region of 0 nm or more and 100 nm or less in the depth direction from the outermost surface of the recording medium. In Examples of the present invention, the existence ratio of the colloidal silica in the depth direction was calculated by the following method.

The cross section of the recording medium is cut out by using a microtome, and then observed under a scanning electron microscope SU-70 (manufactured by Hitachi High-Technologies Corporation) at a magnification of 30,000 times. Then, the visual field in the range of (2 μm in depth direction from outermost surface of ink receiving layer)×(3 μm in perpendicular direction to depth direction) is observed. When described with reference to FIGURE, the visual field in the range surrounded by the dotted lines in the ink receiving layer (Hatched portion of FIGURE) is observed. In this case, X in the range surrounded by the dotted lines is 2 μm and Y in the range is 3 μm. Then, the number A of all the colloidal silica existing in the visual field (i.e., the number A of the colloidal silica existing in a region of 0 μm or more and 2 μm or less in the depth direction from the outermost surface) is counted. Subsequently, the number B of the colloidal silica existing in a region of 0 nm or more and 300 nm or less (or 0 nm or more and 100 nm or less) in the depth direction from the outermost surface within the visual field is counted. In this case, colloidal silica that is partially hidden behind another colloidal silica and colloidal silica that is partially outside the edge of the observation region are also counted as "one particle". By calculating B/A×100, the existence ratio of the colloidal silica existing in the region of 0 nm or more and 300 nm or less (or 0 nm or more and 100 nm or less) in the depth direction from the outermost surface is calculated.

Inorganic Particles Other than Colloidal Silica

In the present invention, the ink receiving layer may contain inorganic particles other than the colloidal silica (hereinafter also simply referred to as "inorganic particles"). The average primary particle size of the inorganic particles is preferably 1 nm or more. Furthermore, the average primary particle size of the inorganic particles is more preferably 1 μm or less. Moreover, the average primary particle size of the inorganic particles is more preferably 30 nm or less and particularly preferably 3 nm or more and 10 nm or less. In the present invention, the average primary particle size of the inorganic particles is a number-average particle size determined from the diameter of a circle having an area equal to the projected area of the primary particles of the inorganic particles when observed under an electron microscope. In this case, the measurement is performed at at least 100 points.

In the present invention, the inorganic particles are preferably used for a coating liquid for the ink receiving layer in the state where the inorganic particles are dispersed by a dispersing agent. The average secondary particle size of the inorganic particles in the dispersion state is preferably 10 nm or more and 500 nm or less, more preferably 30 nm or more and 300 nm or less, and particularly preferably 50 nm or more and 250 nm or less. The average secondary particle size of the inorganic particles in the dispersion state can be measured by a dynamic-light-scattering method.

In the present invention, the application amount ($g/m^2$) of all the inorganic particles containing the colloidal silica to be applied when forming the ink receiving layer is preferably 15 $g/m^2$ or more and 45 $g/m^2$ or less.

Examples of the inorganic particles other than the colloidal silica for use in the present invention include, for example, alumina hydrate, alumina, silica, titanium dioxide, zeolite, kaolin, talc, hydrotalcite, zinc oxide, zinc hydroxide, aluminum silicate, calcium silicicate, magnesium silicicate, zirconium hydroxide, and the like. One or two or more kinds of these inorganic particles can be used as required. Among the inorganic particles, alumina hydrate, fumed alumina particles, and fumed silica capable of forming a porous structure with high ink absorbability are preferably used. In particular, it is preferable from the viewpoint of scratch resistance to use the fumed silica. This is considered to be because the ink receiving layer containing the fumed silica has higher elasticity than the ink receiving layers containing the alumina hydrate and the fumed alumina particles. These inorganic particles are described below.

For the ink receiving layer, an alumina hydrate represented by General Formula (X): $Al_2O_{3-n}(OH)_{2n}.mH_2O$ can be preferably used (In General Formula (X), n is 0, 1, 2, or 3 and m is 0 or more and 10 or less and preferably 0 or more and 5 or less. m and n are not simultaneously 0.).

Since $mH_2O$ represents an aqueous phase which does not participate in the formation of the crystal lattice and which can be disconnected in many cases, m may not be an integer. When the alumina hydrate is heated, m can be 0.

In the present invention, the alumina hydrate can be manufactured by known methods. Specifically, examples of the methods include a method of hydrolyzing aluminum alkoxide, a method of hydrolyzing sodium aluminate, and a method of adding an aqueous solution of aluminum sulfate and aluminum chloride to an aqueous solution of sodium aluminate for neutralizing, and the like.

As the crystal structure of the alumina hydrate, an amorphous type, a gibbsite type, and a boehmite type are known according to the heat treatment temperature. The crystal structure of the alumina hydrate can be analyzed by an X-ray diffraction method. In the present invention, the boehmite type alumina hydrate or the amorphous alumina hydrate is preferably used among the above. As a specific example, alumina hydrates described in Japanese Patent Laid-Open Nos. 7-232473, 8-132731, 9-66664, 9-76628, and the like and Disperal HP14, HP18 (all manufactured by Sasol) and the like as commercially available items can be mentioned. One or two or more kinds of these alumina hydrates can be used as required.

In the present invention, the specific surface area determined by the BET method of the alumina hydrate is preferably 100 $m^2/g$ or more and 200 $m^2/g$ or less and more preferably 125 $m^2/g$ or more and 175 $m^2/g$ or less. Herein, the BET method is a method of adsorbing molecules and ions whose sizes are known to the surface of a sample, and then measuring the specific surface area of the sample from the adsorption amount. In the present invention, nitrogen gas is used as a gas for adsorption to the sample.

The average primary particle size of the alumina hydrate is preferably 5 nm or more and more preferably 10 nm or more. The average primary particle size is preferably 50 nm or less and more preferably 30 nm or less.

As the fumed alumina particles for use in the ink receiving layer, γ-alumina, α-alumina, δ-alumina, θ-alumina, χ-alumina, and the like can be used. Among the above, γ-alumina is preferably used from the viewpoint of optical density of an image and ink absorbability. As specific examples of the fumed alumina particles, AEROXIDE; Alu C, Alu130, Alu65 (all manufactured by EVONIK Industries A.G.), and the like can be mentioned.

In the present invention, the specific surface area determined by the BET method of the fumed alumina particles is preferably 50 $m^2/g$ or more and more preferably 80 $m^2/g$ or more. The specific surface area is preferably 150 $m^2/g$ or less and more preferably 120 $m^2/g$ or less.

The average primary particle size of the fumed alumina particles is preferably 5 nm or more and more preferably 11 nm or more. The average primary particle size is preferably 30 nm or less and more preferably 15 nm or less.

The alumina hydrate and the fumed alumina particles for use in the present invention are preferably mixed as a water dispersion liquid with the coating liquid for the ink receiving layer and acid is preferably used as a dispersing agent therefor. As the acid, sulfonic acid represented by $$R—SO_3H \qquad \text{General Formula (Y):}$$

is preferably used because the effect of suppressing blurring of an image is obtained (In General Formula (Y), R represents any one of a hydrogen atom, an alkyl group in which the number of carbon atoms is 1 or more and 4 or less, and an alkenyl group in which the number of carbon atoms is 1 or more and 4 or less. R may be substituted with an oxo group, a halogen atom, an alkoxy group, and an acyl group.). In the present invention, the content of the acid is preferably 1.0% by mass or more and 2.0% by mass or less and more preferably 1.3% by mass or more and 1.6% by mass or less based on the total content of the alumina hydrate and the fumed alumina particles.

The silica for use in the ink receiving layer is roughly divided into a wet method type and a dry method (gas phase method) type according to the manufacturing method thereof. As the wet method, a method is known which includes generating activated silica by acid decomposition of silicate, moderately polymerizing the same, and then aggregating and precipitating the same to thereby obtain hydrous silica. On the other hand, as the dry method (gas phase method), a method of obtaining anhydrous silica by high-temperature gas-phase hydrolysis of halogenated silicon (flame hydrolysis) or by thermal reduction-vaporization of silica sand and coke through arcing in an electric furnace, and then oxidizing the resulting substance with air (arc process) is known. In the present invention, silica obtained by the dry method (gas phase method) (hereinafter also referred to as "fumed silica") is preferably used. This is because the fumed silica has a particularly large specific surface area, and therefore the ink absorbability is particularly high and the refractive index is low, and therefore transparency can be imparted to the ink receiving layer and good color development properties are obtained. Specific examples of the fumed silica include Aerosil (manufactured by Nippon Aerosil Co., Ltd.) and Reolosil QS type (manufactured by Tokuyama Corporation).

In the present invention, the specific surface area determined by the BET method of fumed silica is preferably 50 $m^2/g$ or more and 400 $m^2/g$ or less and more preferably 200 $m^2/g$ or more and 350 $m^2/g$ or less.

In the present invention, the fumed silica is preferably used for the coating liquid for the ink receiving layer in the state where the fumed silica is dispersed by a dispersing agent. The particle size of the fumed silica in the dispersion state is preferably 500 nm or less and more preferably 200 nm or less. The particle size thereof is more preferably 30 nm or more. The particle size of the fumed silica in the dispersion state can be measured by a dynamic-light-scattering method.

Zirconium Compound

The content of the zirconium compound in the ink receiving layer is preferably 0.2 $mmol/m^2$ or more and more preferably 0.4 $mmol/m^2$ or more from the viewpoint of scratch resistance. The content of the zirconium compound is preferably 1.2 $mmol/m^2$ or less and more preferably 0.8 $mmol/m^2$ or less from the viewpoint of color development properties of an image to be obtained. The content of the zirconium compound in the ink receiving layer is particularly preferably 0.4 $mmol/m^2$ or more and 0.8 $mmol/m^2$ or less.

In the present invention, examples of the zirconium compound include zirconium oxyacetate, zirconium oxychloride, zirconium carbonate ammonium, zirconium chloride oxyhydroxide, and the like. One or two or more kinds thereof can be used as required. Among the above, zirconium carbonate ammonium is preferably used.

Ammonium Salt

In the present invention, the ammonium salt also includes an organic ammonium salt. Specific examples of the ammonium salt include salts of volatile amines, such as ammonia, methylamine, dimethylamine, and trimethylamine, and acids, such as carbonic acid, hydrochloric acid, and acetic acid. One or two or more kinds thereof can be used as required. In the present invention, the above-described zirconium compound and the ammonium salt may be separately incorporated. However, particularly preferably, a method of incorporating an ammonium salt of a zirconium compound is mentioned. In the present invention, when the ammonium salt of the zirconium compound is incorporated, it is understood that both the zirconium compound and the ammonium salt are incorporated. In particular as the ammonium salt of the zirconium compound, zirconium carbonate ammonium is preferably used.

In the present invention, the content of the ammonium salt in the ink receiving layer is preferably 0.2 $mmol/m^2$ or more and more preferably 0.4 $mmol/m^2$ or more from the viewpoint of scratch resistance and ink absorbability. The content is preferably 2.0 $mmol/m^2$ or less and more preferably 0.8 $mmol/m^2$ or less from the viewpoint of suppressing a phenomenon in which an image to be obtained blurs with time, i.e., so-called blurring with time. The content of the ammonium salt in the ink receiving layer is particularly preferably 0.4 $mmol/m^2$ or more and 0.8 $mmol/m^2$ or less. Since the ammonium salt is partially formed into ammonia and the like in order to volatilize, the content of the ammonium salt in the ink receiving layer refers to the content of the ammonium salt which finally remains in the recording medium. Therefore, the content of the ammonium salt in the coating liquid may be different from the content of the ammonium salt in the ink receiving layer. In Examples of the present invention, the content of the ammonium salt was calculated by the following method. First, the recording medium cut out into a size of 2 cm×3 cm was immersed in 1 ml of ion-exchange water for 10 minutes under stirring. Thereafter, the recording medium was taken out, and then the remaining liquid was analyzed by ion chromatography to thereby calculate the content of the ammonium salt in the ink receiving layer.

Hydroxycarboxylic Acid

In the present invention, the hydroxycarboxylic acid refers to a compound containing a hydroxyl group and a carboxyl group and having the hydroxyl group at the a site of the carboxyl group and also includes a hydroxycarboxylic acid salt. A reason why it is required to have the hydroxyl group at the a site of the carboxyl group is as follows. The hydroxycarboxylic acid can control the reactivity of the zirconium compound by coordinating to the zirconium compound, but, because the hydroxyl group is at the a site of the carboxyl group, the coordinating force to the zirconium compound becomes moderate. Examples of the hydroxycarboxylic acid include glycolic acid, lactic acid, tartaric acid, malic acid, hydroxyl butyric acid, citrate, gluconic acid, and the like. One or two or more kinds thereof can be used as required. In particular, tartaric acid is preferable from the viewpoint of scratch resistance.

The content of the hydroxycarboxylic acid in the ink receiving layer is preferably 0.02 mmol/$m^2$ or more and more preferably 0.04 mmol/$m^2$ or more from the viewpoint of scratch resistance. The content is preferably 0.2 mmol/$m^2$ or less and more preferably 0.1 mmol/$m^2$ or less from the viewpoint of suppressing blurring with time. The content of the hydroxycarboxylic acid in the ink receiving layer is particularly preferably 0.04 mmol/$m^2$ or more and 0.1 mmol/$m^2$ or less.

The content of the hydroxycarboxylic acid in the ink receiving layer is preferably 0.01 times or more and more preferably 0.02 times or more the content of the zirconium compound from the viewpoint of scratch resistance and color development properties of an image to be obtained. The content is preferably 0.3 times or less and more preferably 0.1 times or less from the viewpoint of suppressing blurring with time.

The content (mmol/$m^2$) of the ammonium salt based on the content (mmol/$m^2$) of the hydroxycarboxylic acid in the ink receiving layer is preferably 10 times or more and 20 times or less. By setting the contents in the range above, the reactivity of the zirconium compound and the colloidal silica is moderately controlled and the bonding force thereof further increases, so that the scratch resistance improves. When the ammonium salt of the zirconium compound is contained, the content (mmol/$m^2$) of the ammonium salt may be calculated as the content (mmol/$m^2$) of the ammonium salt of the zirconium compound.

Binder

In the present invention, it is preferable for the ink receiving layer to contain a binder. In the present invention, the binder refers to a material capable of bonding inorganic particles, such as colloidal silica, to form a coating film.

In the present invention, the content of the binder in the ink receiving layer is preferably 50% by mass or less and more preferably 30% by mass or less the content of all the inorganic particle including the colloidal silica from the viewpoint of ink absorbability. The ratio is preferably 5.0% by mass or more and more preferably 8.0% by mass or more from the viewpoint of bonding properties of the ink receiving layer.

Examples of the binder include starch derivatives, such as oxidized starch, esterified starch, and phosphorylated starch; cellulose derivatives such as carboxymethyl cellulose and hydroxyethyl cellulose; casein, gelatin, soybean protein, polyvinyl alcohol, and derivatives thereof; polyvinylpyrrolidone; maleic anhydride resin; conjugated polymer latex, such as styrene-butadiene copolymer and a methyl methacrylate-butadiene copolymer; acrylic polymer latex, such as polymers of acrylate and methacrylate; vinyl polymer latex, such as an ethylene-vinyl acetate copolymer; functional group-modified polymer latex of the above-mentioned polymers of monomers containing functional groups, such as carboxyl groups; those obtained by cationizing the above-mentioned polymers with cationic groups; those obtained by cationizing the surfaces of the above-mentioned polymers with cationic surfactants; those obtained by polymerizing monomers constituting the above-mentioned polymers in the presence of cationic polyvinyl alcohol so as to disperse the polyvinyl alcohol on the polymer surfaces; those obtained by polymerizing monomers constituting the above-mentioned polymers in a suspension/dispersion liquid of cationic colloidal particles so as to disperse the cationic colloidal particles on the polymer surfaces; aqueous binders, such as thermosetting synthetic resin, e.g., melamine resin and urea resin; polymers and copolymers of acrylate and methacrylate, such as poly (methyl methacrylate); and synthetic resin, such as polyurethane resin, unsaturated polyester resin, a vinyl chloride-vinyl acetate copolymer, polyvinyl butyral, and alkyd resin. One or two or more kinds of these binders can be used as required.

Among the above-mentioned binders, polyvinyl alcohol and polyvinyl alcohol derivatives are preferably particularly used. Examples of the polyvinyl alcohol derivative include cation-modified polyvinyl alcohol, anion-modified polyvinyl alcohol, silanol-modified polyvinyl alcohol, polyvinyl acetal, and the like. As the cation-modified polyvinyl alcohol, polyvinyl alcohols having primary to tertiary amino groups or a quaternary ammonium group in the main chain or the side chain of polyvinyl alcohol described in Japanese Patent Laid-Open No. 61-10483 are preferable, for example.

The polyvinyl alcohol can be synthesized by saponifying polyvinyl acetate. The degree of saponification of the polyvinyl alcohol is preferably 80% by mol or more and 100% by mol or less and more preferably 85% by mol or more and 98% by mol or less. The degree of saponification is the ratio of the molar number of hydroxyl groups generated by a saponification reaction when polyvinyl acetate is saponified to obtain polyvinyl alcohol, and is a value measured by the method described in JIS-K6726. The average polymerization degree of the polyvinyl alcohol is preferably 2000 or more and more preferably 2000 or more and 5000 or less. In the present invention, as the average polymerization degree, the viscosity average polymerization degree determined by the method described in JIS-K6726 (1994) is used.

When preparing the coating liquid for the ink receiving layer, it is preferable to use polyvinyl alcohol and a polyvinyl alcohol derivative in the form of an aqueous solution. In this case, the solid content of the polyvinyl alcohol and the polyvinyl alcohol derivative in the aqueous solution is preferably 3% by mass or more and 20% by mass or lower.

Crosslinking Agent

In the present invention, it is preferable for the ink receiving layer to contain a crosslinking agent. Examples of the crosslinking agent include aldehyde compounds, melamine compounds, isocyanate compounds, zirconium compounds, amide compounds, aluminum compounds, boric acids, boric acid salts, and the like. One or two or more kinds of these crosslinking agents can be used as required. In particular, when using polyvinyl alcohol and a polyvinyl alcohol derivative as the binder, boric acid and boric acid salts are preferably used among the above-mentioned crosslinking agents.

Examples of the boric acid include orthoboric acid ($H_3BO_3$), metaboric acid, and diboric acid. As the boric acid salt, water-soluble salts of the above-mentioned boric acids are preferable. Examples of the boric acid salt include alkali metal salts of boric acids, such as sodium salts and potassium salts of boric acids; alkaline earth metal salts of boric acids, such as magnesium salts and calcium salts of boric acids; ammonium salts of boric acids; and the like. Among these boric acids and boric acid salts, the use of the orthoboric acid is preferably from the viewpoint of stability with time of the coating solution and the effect of suppressing the occurring of cracking.

The use amount of the crosslinking agent can be adjusted as appropriate according to the manufacturing conditions and the like. In the present invention, the content of the crosslinking agent in the ink receiving layer is preferably 1.0% by mass or more and 50% by mass or less and more preferably 5% by mass or more and 40% by mass or less based on the content of the binder.

When the binder is polyvinyl alcohol and the crosslinking agent is at least one kind selected from the boric acids and the boric acid salts, the total content of the boric acid and the boric acid salt is preferably 5% by mass or more and 30% by mass or less the content of the polyvinyl alcohol in the ink receiving layer.

Other Additives

In the present invention, the ink receiving layer may contain other additives other than the above-described substances. Specific examples of the additives include pH adjusters, thickeners, fluidity modifiers, antifoaming agents, foam inhibitors, surfactants, mold release agents, penetrants, color pigments, color dyes, fluorescent brightening agents, ultraviolet absorbers, antioxidants, antiseptics, antifungal agents, water resistant additives, dye-fixing agents, curing agents, and weather resistant materials.

In the present invention, the content of the alkali metal salt in the ink receiving layer is preferably lower from the viewpoint of suppressing blurring with time. The content of the alkali metal salt in the ink receiving layer is preferably 1.0 $mmol/m^2$ or less and more preferably 0.5 $mmol/m^2$ or less. The alkali metal salt may be contained in the ink receiving layer as impurities of various materials for use in the coating liquid for the ink receiving layer.

Undercoat Layer

In the present invention, an undercoat layer may be provided between the base and the ink receiving layer. By providing the undercoat layer, the adhesiveness between the base and the ink receiving layer can be improved. The undercoat layer preferably contains a water-soluble polyester resin, gelatin, polyvinyl alcohol, and the like. The film thickness of the undercoat layer is preferably 0.01 μm or more and 5 μm or less.

Back Coat Layer

In the present invention, a back coat layer may be provided on a surface opposite to the surface on which the ink receiving layer is provided of the base. By providing the back coat layer, the handling properties, the conveyance aptitude, and the conveyance scratch resistance in continuation printing in the case of loading a large number of sheets can be improved. The back coat layer preferably contains a white pigment, a binder, and the like.

Method of Manufacturing Recording Medium

In the present invention, a method of manufacturing the recording medium is preferably a method having a process of producing the base, a process of preparing the coating liquid for the ink receiving layer, and a process of applying the coating liquid for the ink receiving layer to the base. Hereinafter, the method of manufacturing the recording medium is described.

Method of Producing Base

In the present invention, as a method of producing the base paper, a generally used paper-making method can be applied. Examples of the papermaking machine include Fourdrinier paper machines, cylinder paper machines, drum paper machines, and twin wire paper machines. In order to improve the surface smoothness of the base paper, surface treatment may be performed by applying heat and pressure during the paper-making process or after the paper-making process. Specific examples of the surface treatment methods include calendar treatment, such as machine calendar and super calendar.

Examples of a method of providing a resin layer on the base paper, i.e., a method of covering the base paper with resin, include a melt extrusion method, wet lamination, dry lamination, and the like. Among the above, the melt extrusion method of pressing out molten resin to one surface or both surfaces of the base paper for coating is preferable. As the melt extrusion method, a method of contacting and pressing the conveyed base paper and the resin pressed out from an extrusion die at a nip point between a nip roller and a cooling roller to thereby laminating the resin layer onto the base paper (hereinafter also referred to as an extrusion coating method) is widely adopted. When providing the resin layer by the melt extrusion method, pretreatment may be performed in such a manner that the adhesion of the base paper and the resin layer becomes stronger. Examples of the pretreatment include acid etching treatment with a sulfuric acid-chromic acid mixture, flame treatment with a gas flame, ultraviolet exposure treatment, corona discharge treatment, glow discharge treatment, anchor coat treatment with alkyl titanate, and the like, and the like. Among the above, the corona discharge treatment is preferable. When incorporating a white pigment in the resin layer, the base paper may be covered with a mixture of the resin and the white pigment.

Method of Forming Ink Receiving Layer

In the recording medium of the present invention, as a method of forming the ink receiving layer on the base, the following method can be mentioned, for example. First, the coating liquid for the ink receiving layer is prepared. Then, by applying the coating liquid onto the base, and then drying the same, the recording medium of the present invention can be obtained. As a method of applying the coating liquid, a curtain coater, a coater using an extrusion system, a coater using a slide hopper system, and the like can be used. During the application, the coating liquid may be warmed. Examples of a drying method after the application include methods using hot air dryers, such as a linear tunnel dryer, an arch dryer, an air loop dryer, and a sine curve air float dryer and methods using a dryer utilizing infrared rays or microwaves and the like.

In the present invention, it is preferable to first apply a first coating liquid containing inorganic particles other than colloidal silica and a binders onto the base, and then dry the same, and then apply a second coating liquid containing colloidal silica, a zirconium compound, an ammonium salt, and hydroxycarboxylic acid, and then dry the same. In this case, the application amount of the first coating liquid is preferably 5 $g/m^2$ or more and 45 $g/m^2$ or less in terms of dry solid content. The application amount of the second coating liquid is preferably 0.01 g/m$^2$ or more and 0.5 g/m$^2$ or less in terms of dry solid content. By the use of such a method, the ink receiving layer in which 90% or more of the colloidal silica contained in the ink receiving layer exists in a region of 0 nm or more and 300 nm or less in the depth direction from the outermost surface of the recording medium can be efficiently formed.

EXAMPLES

Hereinafter, the present invention is described in more detail with reference to Examples and Comparative Examples. The present invention is not limited by the following examples without diverting the scope of the present invention. In the following examples, the term "part(s)" is on a mass basis unless otherwise specified.

Production of Recording Medium

Production of Base 80 parts of LBKP having a Canadian Standard Freeness of 450 mLCSF, 20 parts of NBKP having a Canadian Standard Freeness of 480 mLCSF, 0.60 part of cationized starch, 10 parts of heavy calcium carbonate, 15 parts of light calcium carbonate, 0.10 part of alkyl ketene dimer, and 0.030 part of cationic polyacrylamide were mixed, and then water was added in such a manner that the solid content was 3.0% by mass to thereby obtain a paper stuff. Subsequently, the paper stuff was formed into paper with a Fourdrinier paper machine, and then subjected to three-stage wet pressing, followed by drying with a multi-cylinder dryer. Thereafter, the resulting paper was impregnated with an aqueous oxidized starch solution in such a manner that the solid content after the drying was 1.0 g/m$^2$ using a size press apparatus, and then dried. Furthermore, the resulting paper was subjected to finishing treatment with a machine calendar to produce a base paper having a basis weight of 170 g/m$^2$, a stockigt sizing degree of 100 seconds, an air permeability of 50 seconds, a Bekk smoothness of 30 seconds, a Gurley stiffness of 11.0 mN, and a film thickness of 100 μm. Subsequently, a resin composition containing 70 parts of low-density polyethylene, 20 parts of high-density polyethylene, and 10 parts of titanium oxide was applied onto one surface (defined as the front surface) of the base paper in such a manner that the dry application amount was 25 g/m$^2$. Furthermore, a resin composition containing 50 parts of high-density polyethylene and 50 parts of low-density polyethylene was applied onto the back surface of the base paper in such a manner that the dry application amount was 25 g/m$^2$ to obtain a base.

Preparation of Coating Liquid for Ink Receiving Layer

Preparation of First Coating Liquid 1-1

1.54 parts of polydiallyldimethylamine hydrochloride: SHALLOL DC902P (manufactured by Daiichi Kogyo Seiyaku Co., Ltd., solid content of 50% by mass) was added to 79.23 parts of ion-exchange water. 19.23 parts of fumed silica AEROSIL 300 (manufactured by EVONIK Industries A.G.) was added in a small amount while stirring the aqueous solution (the amount ratio of the fumed silica to the polydiallyldimethylamine hydrochloride of 100:4) with a T.K. homomixer MARK II 2.5 (manufactured by Tokusyu Kika Kogyo Co., Ltd.) under the rotation conditions of 3000 rpm. Furthermore, treatment was performed twice with a Nanomizer (manufactured by Yoshida Kikai Co., Ltd.) to prepare a fumed silica dispersion liquid with a solid content of 20% by mass.

Polyvinyl alcohol PVA 235 (manufactured by Kuraray Co., Ltd.) having a viscosity average polymerization degree of 3500 and a saponification degree of 88% by mol was dissolved in ion-exchange water to prepare an aqueous binder solution having a solid content of 8.0% by mass.

Zirconium acetate ZA-30 (manufactured by Daiichi Kigenso Kagaku Kogyo Co., Ltd., solid content of 30% by mass) which was a water-soluble salt of a polyvalent metal and the aqueous binder solution (Solid content of 8.0% by mass) prepared above were mixed with the fumed silica dispersion liquid prepared above in amounts of 2.0 parts and 20.0 parts, respectively, in terms of solid content, based on 100 parts of the fumed silica solid content contained in the fumed silica dispersion liquid to obtain a mixture solution. Subsequently, an aqueous orthoboric acid solution (Solid content of 5% by mass) which was a crosslinking agent was mixed with the resulting mixture solution in an amount of 20.0 parts, in terms of solid content, based on 100 parts of the polyvinyl alcohol solid content contained in the mixture solution. Furthermore, a surfactant Surfinol 465 (manufactured by Nissin Chemical Co., Ltd.) was added thereto in an amount of 0.1% by mass based on the total mass of the coating solution to obtain a first coating solution 1-1.

Preparation of First Coating Liquid 1-2

1.65 parts of methanesulfonic acid was added as peptization acid to 333 parts of ion-exchange water. 100 parts of alumina hydrate DISPERAL HP14 (manufactured by Sasol) was added in a small amount while stirring the aqueous solution with a T.K. homomixer MARK II 2.5 (manufactured by Tokusyu Kika Kogyo Co., Ltd.) under the rotation conditions of 3000 rpm. After the completion of the addition, the mixture was stirred for 30 minutes as it was to thereby prepare an alumina hydrate dispersion liquid with a solid content of 23% by mass.

Polyvinyl alcohol PVA 235 (manufactured by Kuraray Co., Ltd.) having a viscosity average polymerization degree of 3500 and a saponification degree of 88% by mol was dissolved in ion-exchange water to prepare an aqueous binder solution having a solid content of 8.0% by mass.

Zirconium acetate ZA-30 (manufactured by Daiichi Kigenso Kagaku Kogyo Co., Ltd., solid content of 30% by mass) which was a water-soluble salt of a polyvalent metal and the aqueous binder solution (Solid content of 8.0% by mass) prepared above were mixed with the alumina hydrate dispersion liquid prepared above in amounts of 2.0 parts and 9.0 parts, respectively, in terms of solid content, based on 100 parts of the alumina hydrate solid content contained in the alumina hydrate dispersion liquid to give a mixture solution. Subsequently, an aqueous orthoboric acid solution (solid content of 5% by mass) which was a crosslinking agent was mixed with the obtained mixture solution in an amount of 20.0 parts, in terms of solid content, based on 100 parts of the polyvinyl alcohol solid content contained in the mixture solution. Furthermore, a surfactant Surfinol 465 (manufactured by Nissin Chemical Co., Ltd.) was added thereto in an amount of 0.1% by mass based on the total mass of the coating solution to obtain a second coating solution 1-2.

Preparation of Second Coating Liquid

A colloidal silica dispersion liquid described later, a zirconium compound, and hydroxycarboxylic acid were mixed in such a manner that the value of the part(s) of the solid content of each mixture was a value of Table 1. As the colloidal silica dispersion liquid, those shown in Table 2 were used. As the zirconium carbonate ammonium, AC-7 (manufactured by DAIICHI KIGENSO KAGAKU KOGYO CO., LTD.) was used.

TABLE 1

| Preparation conditions of second coating liquid | | | | | | | |
|---|---|---|---|---|---|---|---|
| | Colloidal silica dispersion liquid | | | | | | |
| Second coating liquid No. | Type | Average primary particle size (nm) | Content (Part) | Zirconium compound Type | Zirconium compound Content (Part) | Hydroxycarboxylic acid Type | Hydroxycarboxylic acid Content (Part) |
| Coating liquid2-1 | PL-3L | 35 | 100 | Zirconium carbonate ammonium | 75 | Tartaric acid | 7 |
| Coating liquid2-2 | Snowtex20L | 45 | 100 | Zirconium carbonate ammonium | 75 | Tartaric acid | 7 |
| Coating liquid2-3 | SnowtexYL | 75 | 100 | Zirconium carbonate ammonium | 75 | Tartaric acid | 7 |
| Coating liquid2-4 | PL-3L | 35 | 100 | Zirconium carbonate ammonium | 25 | Tartaric acid | 7 |
| Coating liquid2-5 | PL-3L | 35 | 100 | Zirconium carbonate ammonium | 50 | Tartaric acid | 7 |
| Coating liquid2-6 | PL-3L | 35 | 100 | Zirconium carbonate ammonium | 100 | Tartaric acid | 7 |
| Coating liquid2-7 | PL-3L | 35 | 100 | Zirconium carbonate ammonium | 150 | Tartaric acid | 7 |
| Coating liquid2-8 | PL-3L | 35 | 100 | Zirconium carbonate ammonium | 75 | Tartaric acid | 3 |
| Coating liquid2-9 | PL-3L | 35 | 100 | Zirconium carbonate ammonium | 75 | Tartaric acid | 5 |
| Coating liquid2-10 | PL-3L | 35 | 100 | Zirconium carbonate ammonium | 75 | Tartaric acid | 15 |
| Coating liquid2-11 | PL-3L | 35 | 100 | Zirconium carbonate ammonium | 75 | Tartaric acid | 25 |
| Coating liquid2-12 | PL-3L | 35 | 100 | Zirconium carbonate ammonium | 75 | Glycolic acid | 7 |
| Coating liquid2-13 | PL-3L | 35 | 100 | Zirconium carbonate ammonium | 75 | Lactic acid | 7 |
| Coating liquid2-14 | Snowtex20 | 15 | 100 | Zirconium carbonate ammonium | 75 | Tartaric acid | 7 |
| Coating liquid2-15 | MP1040 | 100 | 100 | Zirconium carbonate ammonium | 75 | Tartaric acid | 7 |
| Coating liquid2-16 | PL-3L | 35 | 20 | Zirconium carbonate ammonium | 75 | Tartaric acid | 7 |
| Coating liquid2-17 | PL-3L | 35 | 200 | Zirconium carbonate ammonium | 75 | Tartaric acid | 7 |
| Coating liquid2-18 | PL-3L | 35 | 500 | Zirconium carbonate ammonium | 75 | Tartaric acid | 7 |
| Coating liquid2-19 | PL-3L | 35 | 100 | Zirconium acetate | 75 | Tartaric acid | 7 |
| Coating liquid2-20 | PL-3L | 35 | 100 | Zirconium nitrate | 75 | Tartaric acid | 7 |
| Coating liquid2-21 | PL-3L | 35 | 100 | Zirconium carbonate ammonium | 75 | Acetic acid | 7 |
| Coating liquid2-22 | PL-3L | 35 | 100 | Zirconium carbonate ammonium | 75 | — | 0 |
| Coating liquid2-23 | PL-3L | 35 | 100 | — | 0 | Tartaric acid | 7 |
| Coating liquid2-24 | — | — | 0 | Zirconium carbonate ammonium | 75 | Tartaric acid | 7 |
| Coating liquid2-25 | PL-3L | 35 | 700 | Zirconium carbonate ammonium | 75 | Tartaric acid | 7 |

TABLE 2

| Type of colloidal silica dispersion liquid | | |
|---|---|---|
| Product name | Manufacture name | Average primary particle size (nm) |
| PL-3L | Fuso Chemical Co., Ltd. | 35 |
| Snowtex20L | Nissan Chemical Industries | 45 |
| SnowtexYL | | 75 |
| Snowtex20 | | 15 |
| MP1040 | | 100 |

Production of Recording Medium

Recording media were produced as follows using the base, the first coating liquid, and the second coating liquid obtained above. The combination of the first coating liquid and the second coating liquid which were used, the application amount (g/m$^2$) of the colloidal silica in an ink receiving layer, the content (mmol/m$^2$) of each material in the ink receiving layer and the ratio thereof (times), and the existence ratio (%) of the colloidal silica existing in a region of 0 nm or more and 300 nm or less from the outermost surface and the existence ratio (%) of the colloidal silica existing in a region of 0 nm or more and 100 nm or less from the outermost surface were measured and calculated by the methods described above. The results are shown in Tables 3 and 4.

Examples 1 to 19 and Comparative Examples 1 to 7

The first coating liquid warmed to 40° C. was applied onto the base using a slide die in such a manner that the film thickness in drying was 40 μm. Then, the air with a temperature: 50° C. and a relative humidity of 10% was applied thereto for drying. Subsequently, the second coating liquid was applied using a gravure roll in such a manner that the content (g/m$^2$) of the colloidal silica in the ink receiving layer was a specific value. Then, the resulting substance was dried at a temperature of 50° C., thereby obtaining a recording medium.

Comparative Example 8

The first coating liquid and the second coating liquid were applied onto the base using a slide die by a simultaneous multilayer coating method. Then, the air with a temperature: 50° C. and a relative humidity of 10% was applied thereto for drying, thereby obtaining a recording medium.

TABLE 3

| Production conditions of recording medium | | | |
|---|---|---|---|
| | | Second coating liquid | |
| Example No. | First coating liquid No. | No. | Application amount of colloidal silica in ink receiving layer ($g/m^2$) |
| Ex. 1 | Coating liquid 1-1 | Coating liquid 2-1 | 0.10 |
| Ex. 2 | Coating liquid 1-1 | Coating liquid 2-2 | 0.10 |
| Ex. 3 | Coating liquid 1-1 | Coating liquid 2-3 | 0.10 |
| Ex. 4 | Coating liquid 1-1 | Coating liquid 2-4 | 0.10 |
| Ex. 5 | Coating liquid 1-1 | Coating liquid 2-5 | 0.10 |
| Ex. 6 | Coating liquid 1-1 | Coating liquid 2-6 | 0.10 |
| Ex. 7 | Coating liquid 1-1 | Coating liquid 2-7 | 0.10 |
| Ex. 8 | Coating liquid 1-1 | Coating liquid 2-8 | 0.10 |
| Ex. 9 | Coating liquid 1-1 | Coating liquid 2-9 | 0.10 |
| Ex. 10 | Coating liquid 1-1 | Coating liquid 2-10 | 0.10 |

TABLE 3-continued

| Production conditions of recording medium | | | |
|---|---|---|---|
| | | Second coating liquid | |
| Example No. | First coating liquid No. | No. | Application amount of colloidal silica in ink receiving layer ($g/m^2$) |
| Ex. 11 | Coating liquid 1-1 | Coating liquid 2-11 | 0.10 |
| Ex. 12 | Coating liquid 1-1 | Coating liquid 2-12 | 0.10 |
| Ex. 13 | Coating liquid 1-1 | Coating liquid 2-13 | 0.10 |
| Ex. 14 | Coating liquid 1-1 | Coating liquid 2-14 | 0.10 |
| Ex. 15 | Coating liquid 1-1 | Coating liquid 2-15 | 0.10 |
| Ex. 16 | Coating liquid 1-1 | Coating liquid 2-16 | 0.02 |
| Ex. 17 | Coating liquid 1-1 | Coating liquid 2-17 | 0.20 |
| Ex. 18 | Coating liquid 1-1 | Coating liquid 2-18 | 0.50 |
| Ex. 19 | Coating liquid 1-2 | Coating liquid 2-1 | 0.10 |
| Comp. Ex. 1 | Coating liquid 1-1 | Coating liquid 2-19 | 0.10 |
| Comp. Ex. 2 | Coating liquid 1-1 | Coating liquid 2-20 | 0.10 |
| Comp. Ex. 3 | Coating liquid 1-1 | Coating liquid 2-21 | 0.10 |
| Comp. Ex. 4 | Coating liquid 1-1 | Coating liquid 2-22 | 0.10 |
| Comp. Ex. 5 | Coating liquid 1-1 | Coating liquid 2-23 | 0.10 |
| Comp. Ex. 6 | Coating liquid 1-1 | Coating liquid 2-24 | 0 |
| Comp. Ex. 7 | Coating liquid 1-1 | Coating liquid 2-25 | 0.70 |
| Comp. Ex. 8 | Coating liquid 1-1 | Coating liquid 2-1 | 0.10 |

TABLE 4

| Physical property value of recording medium | | | | | | | |
|---|---|---|---|---|---|---|---|
| | Content in ink receiving layer ($mmol/m^2$) | | | Ratio of content in ink receiving layer ($mmol/m^2$) (Times) | | Existence ratio of colloidal silica existing in a region of 0 nm or more and 300 nm or less from outermost surface (%) | Existence ratio of colloidal silica existing in a region of 0 nm or more and 100 nm or less from outermost surface (%) |
| Example No. | Zirconium compound | Ammonium salt | Hydroxycarboxylic acid | Hydroxycarboxylic acid/Zirconium compound | Ammonium salt/Hydroxycarboxylic acid | | |
| Ex. 1 | 2.26 | 0.59 | 0.05 | 0.02 | 13 | 100 | 100 |
| Ex. 2 | 2.26 | 0.59 | 0.05 | 0.02 | 13 | 100 | 100 |
| Ex. 3 | 2.26 | 0.59 | 0.05 | 0.02 | 13 | 100 | 100 |
| Ex. 4 | 1.85 | 0.20 | 0.05 | 0.03 | 4 | 100 | 100 |
| Ex. 5 | 2.06 | 0.39 | 0.05 | 0.02 | 8 | 100 | 100 |
| Ex. 6 | 2.46 | 0.78 | 0.05 | 0.02 | 17 | 100 | 100 |
| Ex. 7 | 2.87 | 1.18 | 0.05 | 0.02 | 25 | 100 | 100 |
| Ex. 8 | 2.26 | 0.59 | 0.02 | 0.01 | 29 | 100 | 100 |
| Ex. 9 | 2.26 | 0.59 | 0.03 | 0.01 | 18 | 100 | 100 |
| Ex. 10 | 2.26 | 0.59 | 0.10 | 0.04 | 6 | 100 | 100 |
| Ex. 11 | 2.26 | 0.59 | 0.17 | 0.07 | 4 | 100 | 100 |
| Ex. 12 | 2.26 | 0.59 | 0.09 | 0.04 | 6 | 100 | 100 |
| Ex. 13 | 2.26 | 0.59 | 0.08 | 0.03 | 8 | 100 | 100 |
| Ex. 14 | 2.26 | 0.59 | 0.05 | 0.02 | 13 | 100 | 100 |
| Ex. 15 | 2.26 | 0.59 | 0.05 | 0.02 | 13 | 100 | 100 |
| Ex. 16 | 2.26 | 0.59 | 0.05 | 0.02 | 13 | 100 | 100 |
| Ex. 17 | 2.26 | 0.59 | 0.05 | 0.02 | 13 | 100 | 100 |
| Ex. 18 | 2.26 | 0.59 | 0.05 | 0.02 | 13 | 90 | 30 |
| Ex. 19 | 2.26 | 0.59 | 0.047 | 0.02 | 13 | 100 | 100 |
| Comp. Ex. 1 | 2.26 | 0 | 0.05 | 0.02 | — | 100 | 100 |
| Comp. Ex. 2 | 2.26 | 0 | 0.05 | 0.02 | — | 100 | 100 |
| Comp. Ex. 3 | 2.26 | 0.59 | 0 | 0.00 | — | 100 | 100 |
| Comp. Ex. 4 | 2.26 | 0.59 | 0 | 0.00 | — | 100 | 100 |
| Comp. Ex. 5 | 1.65 | 0 | 0.05 | 0.03 | — | 100 | 100 |
| Comp. Ex. 6 | 2.26 | 0.59 | 0.05 | 0.02 | 13 | 0 | 0 |
| Comp. Ex. 7 | 2.26 | 0.59 | 0.05 | 0.02 | 13 | 75 | 25 |
| Comp. Ex. 8 | 2.26 | 0.59 | 0.05 | 0.02 | 13 | 75 | 25 |

Evaluation

In each of the following evaluations, when an image is recorded on the recording medium, the recording was performed by an ink jet recording apparatus PIXUS MP990 (manufactured by CANON KABUSHIKI KAISHA) to which an ink cartridge BCI-321 (manufactured by CANON KABUSHIKI KAISHA) was attached under the conditions of a temperature of 23° C. and a relative humidity of 50%. In the ink jet recording apparatus, the image recorded under the conditions where one droplet of an about 11 ng ink was added to a unit region (1/600 inch×1/600 inch) at a resolution of 600 dpi×600 dpi is defined as an image with a recording duty of 100%.

Evaluation of Glossiness

The 60° gloss of the recording media was measured by a method described in JIS-Z8741 using a glossmeter VG-2000 (manufactured by Nippon Denshoku Industries Co., LTD.), and then the glossiness was evaluated based on the following criteria. The evaluation criteria are as follows. In the present invention, A to C in the following evaluation criteria are preferable levels and D and E are non-permissible levels. The evaluation results are shown in Table 5.

A: The 60° gloss was 60% or more.

B: The 60° gloss was 50% or more and less than 60%.

C: The 60° gloss was 40% or more and less than 50%.

D: The 60° gloss was 30% or more and less than 40%.

E: The 60° gloss was less than 30%.

Evaluation of Scratch Resistance

The scratch resistance of the recording media was evaluated using the Gakushin-Type Rubbing Tester II type (manufactured by TESTER SANGYO CO., LTD.) according to JIS-L0849. Specifically, the evaluation was performed as follows. Each recording medium was set on a vibration table of the rubbing tester in such a manner that the ink receiving layer side faced upward. Then, one in which a Kim Towel was attached to a friction element on which a 100 g weight was placed was moved back and forth five times in such a manner as to rub the front surface of the recording medium. Thereafter, the 75° gloss of the rubbed region and the region which was not rubbed was measured, and then a difference in the 75° gloss [=(75° gloss of rubbed region)−(75° gloss of region which was not rubbed)] was calculated. Since the rubbed region has such a tendency that, as the scratch resistance of a recording medium is lower, the 75° gloss becomes higher, and therefore the difference in the 75° gloss becomes larger. The 75° gloss was measured by a method described in JIS-28741. The evaluation criteria are as follows. In the present invention, A to C in the following evaluation criteria are preferable levels and D and E are non-permissible levels. The evaluation results are shown in Table 5.

A: The difference in the 75° gloss was less than 5%.

B: The difference in the 75° gloss was 5% or more and less than 10%.

C: The difference in the 75° gloss was 10% or more and less than 15%.

D: The difference in the 75° gloss was 15% or more and less than 20%.

E: The difference in the 75° gloss was 20% or more.

Evaluation of Ink Absorbability

On the recording media, four green solid images with a recording duty of 200%, 250%, 300%, and 350% were recorded using the ink jet recording apparatus described above. By visually confirming whether a beading phenomenon occurred in the obtained images, the ink absorbability was evaluated. The beading phenomenon is a phenomenon in which ink droplets before being absorbed into a recording medium are combined and is known to have a high correlation with the ink absorbability. More specifically, when the beading phenomenon does not occur in the images with a high recording duty, it can be judged that the ink absorbability of the recording medium is high. The evaluation criteria are as follows. The evaluation results are shown in Table 5.

A: Even in the image with a recording duty of 350%, the beading phenomenon did not occur.

B: In the image with a recording duty of 350%, the beading phenomenon occurred but in the image with a recording duty of 300%, the beading phenomenon did not occur.

C: In the image with a recording duty of 300%, the beading phenomenon occurred but, in the image with a recording duty of 250%, the beading phenomenon did not occur.

D: In the image with a recording duty of 250%, the beading phenomenon occurred but, in the image with a recording duty of 200%, the beading phenomenon did not occur.

E: Even in the image with a recording duty of 200%, the beading phenomenon occurred.

Evaluation of Blurring with Time

A character "A" (20 points) in white (ink was not given) on a blue background was recoded using cyan and magenta by an ink jet recording apparatus on each recording medium in the mode of "Glossy pro, Platinum grade, No color correction". In this case, the recording duty of the cyan was set to 150% and the recording duty of the magenta was set to 150%. The obtained images were stored for one week under the conditions where the temperature was 30° C. and the relative humidity was as high as 80%, and then the white portion of the images was visually observed to evaluate the moisture resistance of the images. The evaluation criteria are as follows. The evaluation results are shown in Table 5.

A: The bleeding of the color to the white portion of the image was not observed.

B: A: The bleeding of the color to the white portion of the image was slightly observed but was negligible.

C: The bleeding of the color to the white portion of the image was observed but the line width of the white portion was half or more of that before the storage test.

D: The bleeding of the color to the white portion of the image was observed and the line width of the white portion was less than half of that before the storage test.

E: The bleeding of the color to the white portion of the image was noticeably observed and the original character was not be able to recognize.

TABLE 5

| Evaluation results | | | | |
|---|---|---|---|---|
| | Evaluation results | | | |
| Example No. | Glossiness | Scratch resistance | Ink absorbability | Blurring with time |
| Ex. 1 | A | A | A | A |
| Ex. 2 | A | A | A | A |
| Ex. 3 | A | B | A | A |
| Ex. 4 | B | C | C | A |
| Ex. 5 | B | B | B | A |
| Ex. 6 | A | A | A | B |
| Ex. 7 | A | A | A | C |
| Ex. 8 | A | B | A | A |
| Ex. 9 | A | A | A | A |
| Ex. 10 | A | A | A | B |
| Ex. 11 | A | A | A | C |
| Ex. 12 | A | B | A | A |
| Ex. 13 | A | B | A | A |
| Ex. 14 | A | A | C | A |
| Ex. 15 | B | C | A | A |
| Ex. 16 | B | B | A | A |
| Ex. 17 | A | A | B | A |

TABLE 5-continued

| Evaluation results | | | | |
|---|---|---|---|---|
| | Evaluation results | | | |
| Example No. | Glossiness | Scratch resistance | Ink absorbability | Blurring with time |
| Ex. 18 | A | A | C | A |
| Ex. 19 | A | C | A | A |
| Comp. Ex. 1 | B | D | D | A |
| Comp. Ex. 2 | B | D | D | A |
| Comp. Ex. 3 | B | D | A | A |
| Comp. Ex. 4 | B | D | A | A |
| Comp. Ex. 5 | D | E | E | A |
| Comp. Ex. 6 | E | E | A | A |
| Comp. Ex. 7 | A | A | D | A |
| Comp. Ex. 8 | A | D | A | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-163274, filed Aug. 6, 2013, which is hereby incorporated by reference herein in its entirety.

What is claimed is:

1. A recording medium, comprising: a base and an ink receiving layer, wherein the ink receiving layer contains a colloidal silica, a zirconium compound, an ammonium salt, and a hydroxycarboxylic acid, and 90% or more of the colloidal silica contained in the ink receiving layer exists in a region of 0 nm or more and 300 nm or less in a depth direction from an outermost surface of the recording medium.

2. The recording medium according to claim 1, wherein an average primary particle size of the colloidal silica is 20 nm or more and 100 nm or less.

3. The recording medium according to claim 1, wherein a content of the colloidal silica in the ink receiving layer is 0.02 $g/m^2$ or more and 0.1 $g/m^2$ or less.

4. The recording medium according to claim 1, wherein a content of the zirconium compound in the ink receiving layer is 0.4 $mmol/m^2$ or more and 0.8 $mmol/m^2$ or less.

5. The recording medium according to claim 1, wherein a content of the ammonium salt in the ink receiving layer is 0.4 $mmol/m^2$ or more and 0.8 $mmol/m^2$ or less.

6. The recording medium according to claim 1, wherein a content of the hydroxycarboxylic acid in the ink receiving layer is 0.04 $mmol/m^2$ or more and 0.1 $mmol/m^2$ or less.

7. The recording medium according to claim 1, wherein the hydroxycarboxylic acid is tartaric acid.

8. The recording medium according to claim 1, wherein a content ($mmol/m^2$) of the ammonium salt to the content ($mmol/m^2$) of the hydroxycarboxylic acid in the ink receiving layer is 10 times or more and 20 times or less.

9. The recording medium according to claim 1, wherein a content of the colloidal silica in the ink receiving layer is 0.01 $g/m^2$ or more and 0.5 $g/m^2$ or less, wherein a content of the zirconium compound in the ink receiving layer is 1.86 $mmol/m^2$ or more and 2.87 $mmol/m^2$ or less, wherein a content of the ammonium salt in the ink receiving layer is 0.2 $mmol/m^2$ or more and 2.0 $mmol/m^2$ or less, and wherein a content of the hydroxycarboxylic acid in the ink receiving layer is 0.02 $mmol/m^2$ or more and 0.2 $mmol/m^2$ or less.

10. The recording medium according to claim 1, wherein a content of the colloidal silica in the ink receiving layer is 0.02 $g/m^2$ or more and 0.1 $g/m^2$ or less, wherein a content of the zirconium compound in the ink receiving layer is 1.86 $mmol/m^2$ or more and 2.87 $mmol/m^2$ or less, wherein a content of the ammonium salt in the ink receiving layer is 0.4 $mmol/m^2$ or more and 0.8 $mmol/m^2$ or less, and wherein a content of the hydroxycarboxylic acid in the ink receiving layer is 0.04 $mmol/m^2$ or more and 0.1 $mmol/m^2$ or less.

11. The recording medium according to claim 1, wherein a content ($mmol/m^2$) of the hydroxycarboxylic acid to the content ($mmol/m^2$) of the zirconium compound in the ink receiving layer is 0.01 times or more and 0.02 times or less.

12. The recording medium according to claim 1, wherein a content of the colloidal silica in the ink receiving layer is 0.01 $g/m^2$ or more and 0.5 $g/m^2$ or less.

* * * * *